United States Patent [19]

Previtali

[11] Patent Number: 4,595,194

[45] Date of Patent: Jun. 17, 1986

[54] BAG PORTABLE BICYCLE TRAINING APPARATUS

[76] Inventor: Giovanni Previtali, Via Verdi 8,, 21040 Carnago (Varese), Italy

[21] Appl. No.: 532,173

[22] Filed: Sep. 14, 1983

[51] Int. Cl.[4] ..... A63B 21/00

[52] U.S. Cl. ..... 272/73

[58] Field of Search ..... 272/73, 132; 135/111–113

[56] References Cited

U.S. PATENT DOCUMENTS

| | | | |
|---|---|---|---|
| 553,373 | 1/1896 | Webber | 272/73 |
| 3,105,505 | 10/1963 | Maybee | 135/113 |
| 3,441,037 | 4/1969 | Transeau | 135/112 |
| 4,026,546 | 5/1977 | Omori | 272/73 |
| 4,066,089 | 1/1978 | Rainwater | 135/111 |

FOREIGN PATENT DOCUMENTS

| | | | |
|---|---|---|---|
| 2333529 | 5/1975 | France | 272/73 |
| 2403090 | 5/1979 | France | 272/73 |
| 577326 | 7/1976 | Switzerland | 272/73 |
| 1476350 | 6/1977 | United Kingdom | 272/73 |
| 2026876 | 2/1980 | United Kingdom | 272/73 |

*Primary Examiner*—Richard J. Apley
*Assistant Examiner*—S. R. Crow
*Attorney, Agent, or Firm*—Gifford, Groh, VanOphem, Sheridan, Sprinkle & Dolgorukov

[57] ABSTRACT

A portable bicycle training apparatus comprises an integrated but collapsible structure weighing about 7 Kg. When collapsed, the structure can be placed in an elongated bag which is longer than it is thick. From the collapsed condition pillars which support a bicycle, at one end of the rear axle bracket of the bicycle, can be extended from a base member. The pillars also serve to support a remote control for a brake, in a position convenient for the user during training.

7 Claims, 6 Drawing Figures

BAG PORTABLE BICYCLE TRAINING APPARATUS

BACKGROUND OF THE INVENTION

I. Field of the Invention

The present invention relates to a collapsible bicycle training apparatus weighing about 7 Kg, which, when collapsed, can be placed in a bag 58 cm by 52 cm by 21 cm in dimension.

II. Description of the Prior Art

A known bicycle training apparatus is disclosed in United Kingdom Patent Application GB No. 2026876A, filed Mar. 9, 1979, entitled "BICYCLE TRAINING APPARATUS", which claims priority from Italian Utility Model Application No. 60925B/78. The device disclosed therein is a considerable advance over the art of bicycle apparatus because it is capable of being used with a wide range of bicycles of differing shapes and sizes. The apparatus disclosed in that application is collapsible, but some difficulties are encountered upon the attempt to assemble the device, and the device is not easily transported when collapsed. Moreover, the device requires some assembly and disassembly during use. Even if such assembly and disassembly were easy, to the mind of a lazy user these could provide a justification for a delay in training. Sports training represents a tribute of suffering, in return for health and fitness. Such an apparatus should be available anywhere, and at any time, so as to be useful to potential users who are otherwise kept away from gymnasiums and roads in the course of their daily business.

SUMMARY OF THE INVENTION

An object of the present invention is to provide a bicycle training apparatus which obviates the aforementioned disadvantages, and which incorporates means enabling it to be used by any user with any bicycle, at any time and at any location. With this object in view, the present invention provides a bicycle training apparatus which is adapted to receive and form a stationary mounting for a bicycle, which can then be ridden under conditions simulating road use, and which is quickly and easily collapsible and disposable in a bag of a reduced size, which is adapted to be carried by the user and which remains with the user anywhere.

In the present invention, these advantages are obtained by the provision of an extending hinged member connected to a frame and disposable in at least two positions: a first extended position, suitable to receive the forward wheel tire; and a second collapsed position wherein the extending member is folded, and attached parallel to the frame. A road simulating means is provided by a single drums. A brake control comprises a knobbed bolt, placed at the top of an arcuate hollow member, whose level (as well as that of uprights which support the bicycle rear wheel axle) may be adjusted in accordance with the needs of the user. In effect, the level of the whole bicycle can be adjusted in such a fashion. Also, the uprights can be swung parallel to the frame, by releasing two butterfly bolts and simply lowering the uprights. The knobbed bolt is placed at the top of the arcuate hollow member and is easily adjustable by the user to provide a remote control, whereby the user may adjust the braking power of the road simulating drum. However, an important object of the present invention is to provide an apparatus characterized by an integrated unit having a weight of about 7 Kg, which, in a collapsed condition, can be placed in a bag which extends more in length and height than in thickness. The bag is substantially shaped as a prism 21 cm thick, whose sides are in the shape of an isosceles trapezoid having a height of 52 cm, and parallel edges 30 and 58 cm in length. The bag includes a pair of large handles integrally formed with the top sides of the trapezoids, each of the handles comprising a single closed band.

BRIEF DESCRIPTION OF THE DRAWING

A better understanding of the bicycle training apparatus according to the present invention will be had upon reference to the following detailed description when read in conjunction with the accompanying drawings, wherein like reference characters refer to like parts throughout the several views, and in which.

DETAILED DESCRIPTION OF THE PREFERRED EMBODIMENT OF THE PRESENT INVENTION

Figure 1:
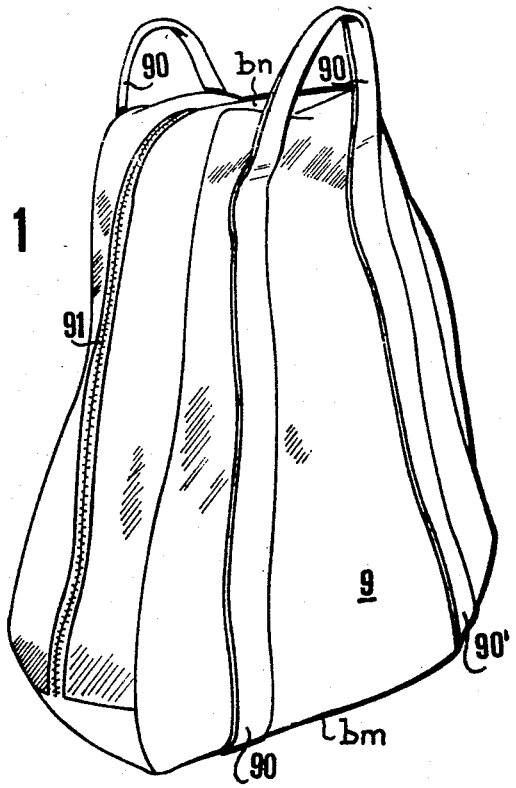
FIG. 1 is a perspective view of a bag containing the collapsed bicycle training apparatus according to the present invention.

With reference now to the Figures, the bicycle training apparatus according to the present invention first comprises a generally triangular lattice base frame 1, which is preferably hollow. An apex 10 of the lattice base frame 1 is provided with a square cross-sectioned joint member 12. The triangular lattice base frame 1 is supported by three short legs 20, 21 and 22, each of which is provided with an antislip shoe 20', 21', and 22'. The bicycle carrying and operating members of the apparatus are connected to the lattice base frame 1. In particular, the joint member 12 receives a spine 3 therein, the spine 3 comprising two sections 30 and 31, and an elbow 32 having hinges 32' and 32''. An outward end of spine section 31 is provided with a short bottom leg 23 having a shoe 23', and with an upper, elongated locator or receiver in the form of a channel member 33, for carrying the forward wheel tire (not shown) of a bicycle 0.

Figure 6:
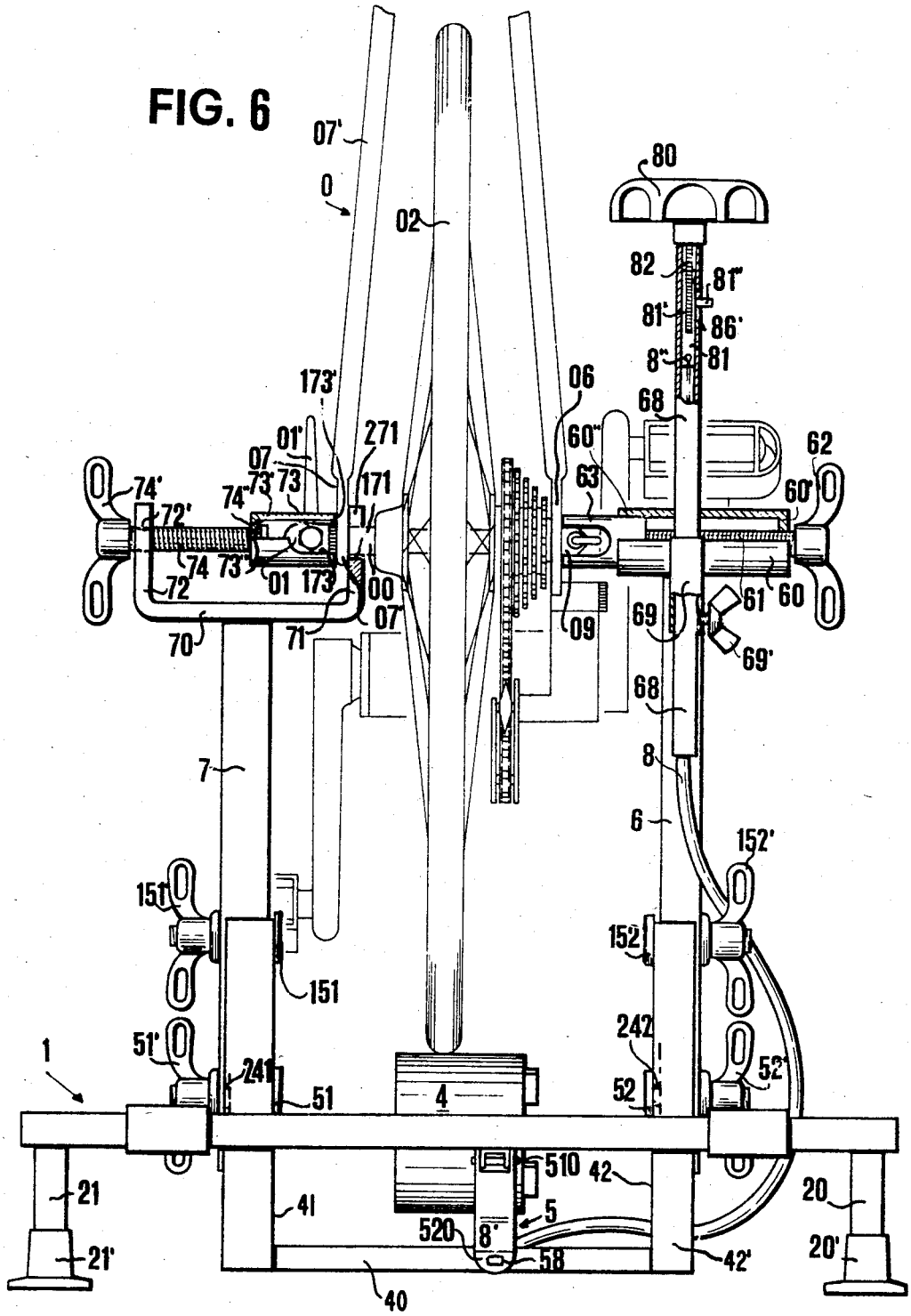
FIG. 6 is a rear, enlarged view of the bicycle training apparatus according to the present invention, with a racing bicycle mounted thereon, in position during use.

The lattice base frame 1 also comprises a pair of elongated parallel members 13 and 13'. At a short distance from the back side 11 of the frame 1, the frame sections 13 and 13'are attached to a "U"-shaped bracket comprising a base section 40 and two upright sections 41 and 42, each of the latter being in the form of an angle member. Each of the uprights 41 and 42 comprises one side 41' or 42', respectively, parallel to the frame back side 11; and another side 41'' or 42'', respectively, parallel to the elongated members 13 and 13'. The upper ends of the uprights 41 and 42, that is, of sides 41" and 42", are provided with seats 141 and 142, in the form of a saddle, as further described below. Each of the uprights 41 and 42 is provided with a hole 241 or 242 on their sides 41" and 42", at the level of the elongated members 13 and 13', to receive a bolt 51 or 52 therein, respectively. With particular reference to FIG. 6, each of the uprights 41 and 42 is coupled by the bolts 51 and 52 and a pair of corresponding nuts 51' and 52' (as well as by additional pairs of bolts 151 and 152, and butterfly nuts 151' and 152', whose function will explained below) to one of a complementary pair of pillars 7 and 6, respectively. An upper end of the pillar 6 is provided with a socket 60 having a hollow space which receives, at one end 60', a bolt 61 having a butterfly head 62; and, at another end 60", a pressing member or bushing 63 whose purpose is described below. A vertical socket 69 having a square cross section is connected to the socket 60, which receives a sliding rod 68 therein. The sliding rod 68 can be fastened in the vertical socket 69 by a butterfly bolt 69'. The sliding rod 68 is hollow and receives a cable 8 therein. An upper end of the sliding rod 68 is provided with a knob 80. The function of the cable 8 and the knob 80 will be further described below.

The other pillar 7 bears a "U"-shaped member 70 on an upper end, comprising a pair of uprights 71 and 72. The upright 72 is provided with a threaded hole 72' therethrough, whose purpose will be described below. The upright 71 is provided with a saddle seat 171, which is substantially coaxial with the hole 72'. A butterfly bolt 74' is mounted in the threaded hole 72', the butterfly bolt 74' possessing a screw 74. A free end 74" of the bolt 74' is idly connected to a pressing member 73. In particular, a groove 73" is formed on the free end 74" of the screw 74, which receives an inner flange edge 73' of the pressing member 73. The pressing member 73 is in the form of a bushing, which is provided with a pair of forward sockets 173. In other words, the pressing member or bushing 73 is shaped and sized so as to receive therein any nut, generally described as a nut 01, such as polygonal nut, an eared nut 01', a butterfly nut or the like, of any bicycle rear axle 00. Since the pressing member or bushing 73 receives the whole nut 01 in its hollow end sockets 173, a flat forward surface 173' of the bushing 73 engages a surface 07 of the rear axle bracket 07' of the bicycle 0. Thus, the a bracket 07' is urged towards a bicycle wheel 02. However, since a rear surface 07" of the rear axle bracket 07' is engaged by the arms 271 of the upright 71, the rear axle bracket 07' of the bicycle 0 is strongly fastened to the apparatus.

Still referring to FIG. 6, another pressing member or bushing 63 operates in a like manner at the other end of the rear axle 00. The pressing member or bushing 63, however, simply engages the outer surface of the other rear axle bracket 06.

Figure 5:
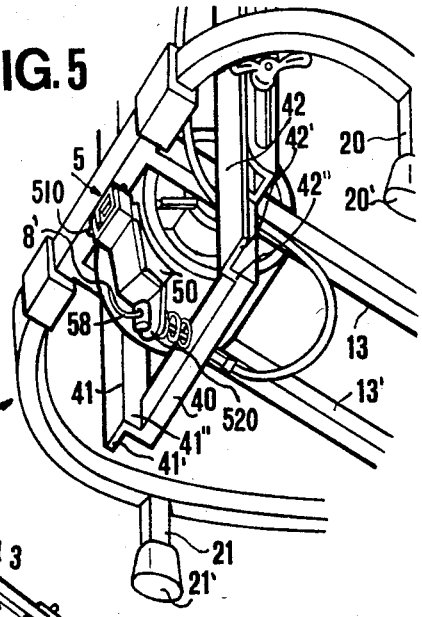
FIG. 5 is a bottom, fragmentary perspective view of the bicycle training apparatus according to the present invention, in slightly enlarged scale from the earlier figures.

It should be appreciated that the fastening power provided by the pressing member or bushing 73 is more effective in fastening the bicycle 0 to the apparatus, due to the abutment against the rear surface of the bracket member. In contrast, the pressing member or bushing 63 engages only one surface of the other axle bracket 06 of the bicycle 0 and provides only a vertical support to receive an axle nut 09 in its hollow space. Thus, the axial power applied by the bushing 63 upon the surface of the axle bracket 06 is not impeded by any other abutment. Reference will now be had to the portions of the apparatus which simulate the road. These portions first comprise a road-simulating roller 4, which provides support for the bicycle 0, and a braking means 5 to simulate different road gradients and/or conditions. The brake means 5 first comprises a plunger 50 (FIG. 5), connected for swinging movement about a fulcrum 510, in the form of a lever of the first class. An effort end 520 of the plunger 50 is driven by an end 58 of the operating cable 8' (FIG. 6) which is slidably mounted through a sheath 8. The other end 8" (FIG. 6) of the cable 8' is connected to a bushing 81 having a threaded hole 81' therein, which receives a bolt portion 82 affixed to the knob 80. The bushing 81 is provided with a radial rod 81" engaged in a lengthwise opening 86' through the hollow upright 68. It is thus evident that clockwise or counterclockwise rotation of the knob 80 adjusts the brake to suit the needs of the user.

Figure 2:
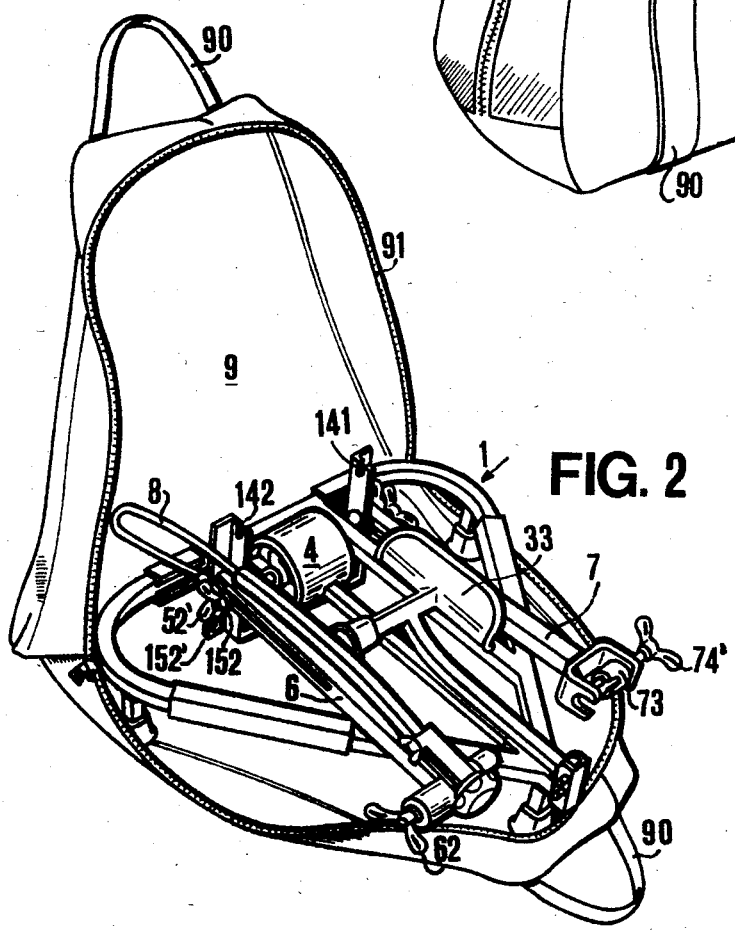
FIG. 2 is a perspective view corresponding to FIG. 1, wherein the bag is open, showing the bicycle training apparatus according to the present invention available for use.

Referring again to FIGS. 1 and 2, it should be understood that the apparatus when collapsed can be disposed in a bag 9 extending more in length and height than in thickness. The bag 9 is substantially shaped as a prism having a thickness of 21 cm, whose faces are in the shape of a pair of isosceles trapezoids 52 cm in height, and having parallel edges 30 cm and 58 cm long. The bag 9 is provided with a pair of large handles 90, extending from the shorter top edges bn of the trapezoidal sides, each of the handles 90 comprising a single closed band 90'. The bag 9 is provided with a slip fastener 91 extending along three sides, so that the bag may be opened substantially flat (FIG. 2). It should also be understood that, as shown in FIGS. 1 and 2, the apparatus can be collapsed to a substantially flat shape, allowing the bag 9 to achieve a substantially flat shape as well. Once the apparatus according to the present invention is taken from the bag it is in the condition as shown in FIG. 2.

Figure 3:
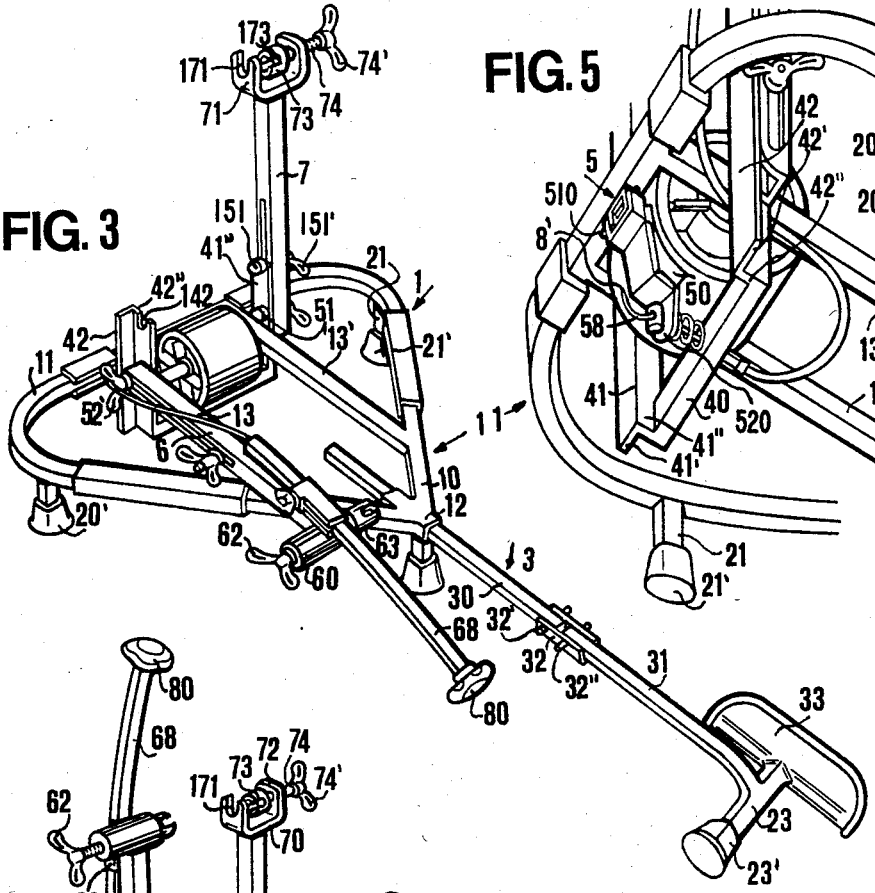
FIG. 3 is a perspective view of the bicycle training apparatus removed from the bag and partially extended.
Figure 4:
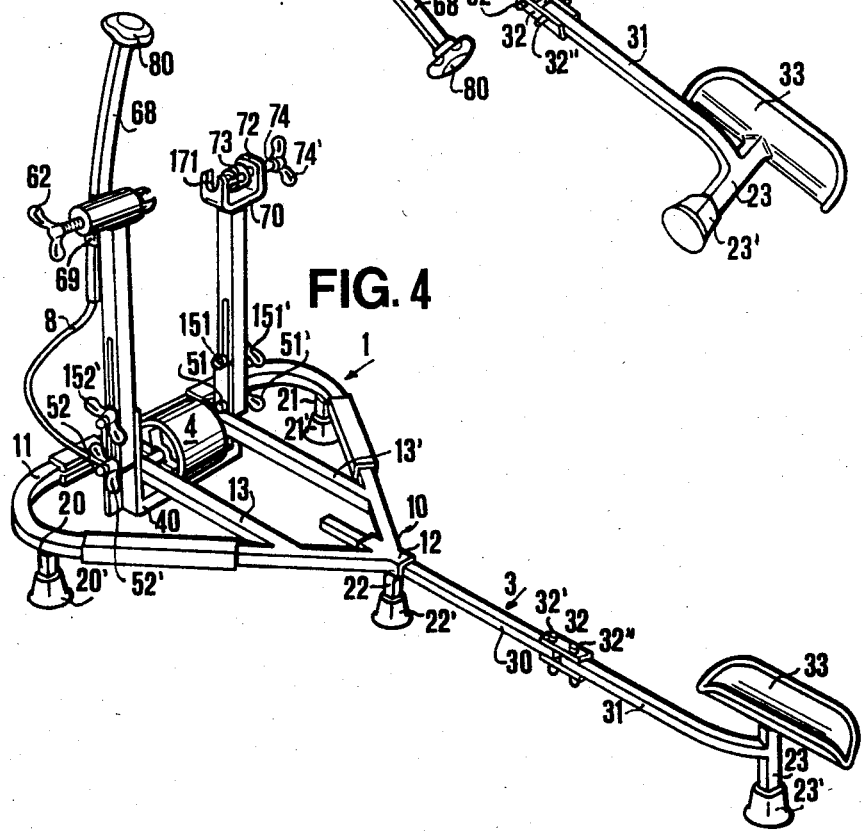
FIG. 4 is a perspective view of the bicycle training apparatus according to the present invention in a fully extended position and ready for the mounting of a bicycle thereon.

The first steps to be taken in the erection of the apparatus are shown in FIG. 3. The uprights 6 and 7 are raised, and the spine 3 is completely removed from the joint 12 and remounted therein after a counterclockwise rotation of 90°, so as to place the leg 23 vertical and parallel to the leg 22. As is shown in FIG. 4, the channel member 33 is open to the top.

It will be appreciated that the uprights 6 and 7 are simply swung upwards, and the bolts 151 and 152 set in the seats 141 and 142, respectively. This is particularly easy since the uprights 6 and 7 are provided with lengthwise openings therethrough, in which the bolts 151 and 152 are disposed. After being set in the seats 141 and 142, the butterfly nuts 151' and 152' are fastened. The apparatus is then fully erect and ready to receive thereon one of a wide range of bicycles, for example, that shown in the drawings as bicycle 0. Of course, several of the apparatus members are adjustable to adapt the apparatus to the particular bicycle employed. These particular members include the butterfly nuts and bolts 151', 152', 62, 74' and 69', as well as the channel member 33.

It should be understood that there is no need for making any physical adaptation or modification to the bicycle itself, even of a temporary nature.

It is also to be understood that the foregoing description serves only to illustrate one form the apparatus can take, and that variations can be made thereto without departing from the scope of the invention, as defined by the following claims.

What is claimed is:

1. A unitary collapsible bicycle training apparatus for use with a bicycle comprising front and rear wheels, a rear axle, rear axle nuts and a rear wheel bracket, said apparatus comprising a metal lattice base structure;

road simulating means comprising a roller rotatably attached to said base structure;

remote means for controlling said road simulating means;

a spine comprising first and second portions hingedly secured to one another and said first portion being extensible from said base structure so as to elongate said base structure wherein said spine is engageable with said front bicycle wheel and wherein said second portion of said spine is hingedly collapsible onto said base structure; and longitudinally and vertically extensible means for stationarily mounting said bicycle to said apparatus, said vertically extensible means hingedly mounted to said base structure and engageable with said rear axle, rear axle nuts and rear wheel bracket of said bicycle, so as to support said bicycle, and to support said remote control means in a position convenient to the user of said apparatus.

2. The invention according to claim 1, wherein said apparatus weights about 7 Kg.

3. The invention according to claim 1, further comprising a bag whose length exceeds its thickness and which is adapted to contain the other elements of said apparatus while in a collapsed state.

4. The invention according to claim 3, wherein said bag is shaped in the form of a prism having a pair of opposing trapezoidal faces; a zip-fastener running along three sides of said bag; and a pair of handles opposite the remaining side of said bag, one on each of said faces of said bag.

5. The invention according to claim 1, additionally comprising buttefly bolts and nuts wherein erection and collapse of said apparatus are achievable by operation of said butterfly bolts and nuts substantially without removal of said bolts from said apparatus.

6. The invention according to claim 1, wherein said base comprises a square cross-sectioned bushing receiving said spine therein, and wherein said spine comprises a hinge, so that said spine is receivable in said bushing in two different angular positions corresponding to extended and collapsed conditions.

7. The invention according to claim 1, wherein said longitudinally and vertically extensible means comprises a first pivotable pillar having a pair of uprights disposed thereon, and means for affixing said rear wheel bracket in a position between said uprights.

* * * * *